US005845695A

United States Patent [19]

Cadorette et al.

[11] Patent Number: 5,845,695

[45] Date of Patent: Dec. 8, 1998

[54] TRAVERSING AND ROTATING WAND FOR VERTICAL BLINDS

[75] Inventors: Mario Cadorette, Saint Therese; Christian Laing, Laval; Viet Pham, Ville Saint Laurent, all of Canada

[73] Assignee: All-Teck Blinds, P.T.B. Inc., Montreal

[21] Appl. No.: 851,717

[22] Filed: May 5, 1997

[51] Int. Cl.[6] ..... E06B 9/30

[52] U.S. Cl. ..... 160/173 V; 160/168.1 V; 160/176.1 V; 160/177 V; 160/178.1 V; 74/89.14; 74/411.5; 192/48.91

[58] Field of Search ..... 160/167 R, 167 V, 160/168.1 R, 168.1 V, 173 V, 174 R, 174 V, 176.1 R, 176.1 V, 177 R, 177 V, 178.1 V; 192/48.91, 69.63; 74/89.14, 425, 411.5, 462

[56] References Cited

U.S. PATENT DOCUMENTS

| | | | |
|---|---|---|---|
| 558,372 | 4/1896 | Errington | 192/48.91 X |
| 1,648,996 | 11/1927 | Reibel | 192/69.63 |
| 1,854,829 | 4/1932 | Doring et al. | 192/69.63 X |
| 4,200,135 | 4/1980 | Hennequin | 160/168.1 R |
| 4,267,875 | 5/1981 | Koks . | |
| 4,316,493 | 2/1982 | Arena . | |
| 4,456,049 | 6/1984 | Vecchiarelli | 160/176.1 R |
| 4,621,672 | 11/1986 | Hsu | 160/176.1 R X |
| 4,799,527 | 1/1989 | Villoch et al. | 160/168.1 |
| 5,002,113 | 3/1991 | Georgopoulos . | |
| 5,038,843 | 8/1991 | Sommerfeld . | |
| 5,413,162 | 5/1995 | Ciriaci | 160/177 V |
| 5,465,779 | 11/1995 | Rozon . | |
| 5,501,116 | 3/1996 | Weng | 160/174 V X |
| 5,575,323 | 11/1996 | Smuckler | 160/177 V |

FOREIGN PATENT DOCUMENTS

| | | |
|---|---|---|
| 9229861 | 6/1993 | Australia . |
| 1 244 752 | 11/1988 | Canada . |
| 2 125 241 | 12/1994 | Canada . |

*Primary Examiner*—Daniel P. Stodola
*Assistant Examiner*—Bruce A. Lev
*Attorney, Agent, or Firm*—Sughrue, Mion, Zinn, Macpeak & Seas, PLLC

[57] ABSTRACT

A vertical blind control includes a single control mechanism for traversing the vanes (8), i.e., opening or closing the blind, and for rotating the vanes to change the amount of light admitted by the closed blind. The control mechanism includes a wand (29), which is used to slide and rotate a shaft (35) carrying opposed bevel gears. One bevel gear (72) is engageable with a mating gear system (76) connected to a tilt rod (10) for rotating the vanes. The other bevel gear (63) is engageable with a drum (48) carrying a cord (13) for traversing the vanes to open or close the blind. The shaft is slidable within the mechanism so that only one of the bevel gears is engaged at any one time to effect the desired operation.

18 Claims, 9 Drawing Sheets

FIG. 12a
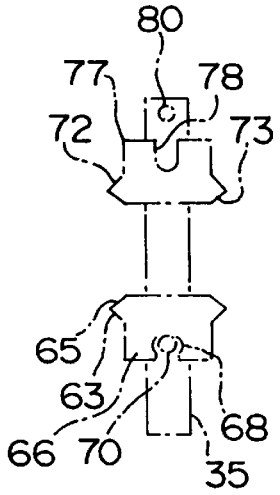
FIG. 12b
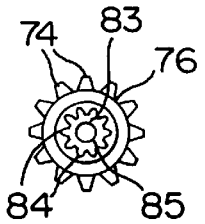
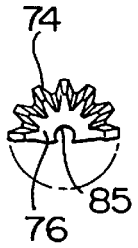
FIG. 12c
FIG. 12d
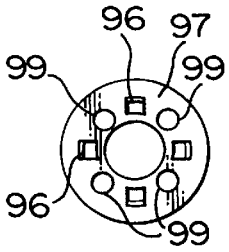
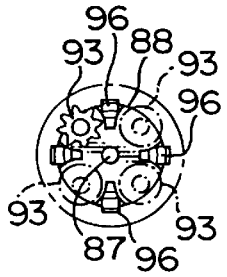
FIG. 12e
FIG. 12f
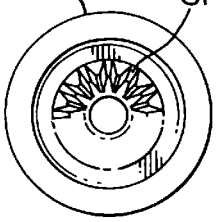
FIG. 12g
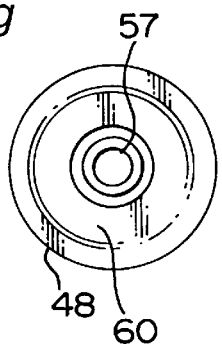
FIG. 12h
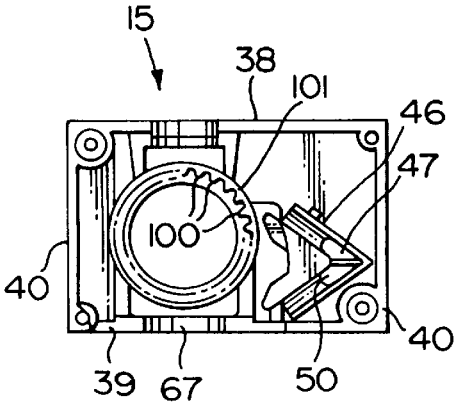
FIG. 12i
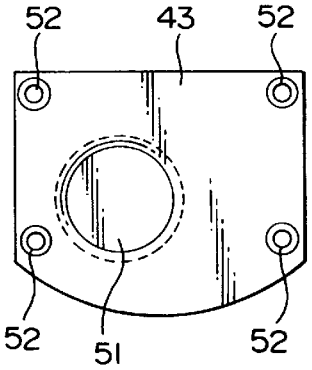

TRAVERSING AND ROTATING WAND FOR VERTICAL BLINDS

BACKGROUND OF THE INVENTION

This invention relates to a vertical blind control, and in particular to a single control for selectively traversing and rotating the vanes of a vertical blind.

Vertical blinds have become increasingly popular over the past several years. Such blinds typically include a casing or headrail containing tracks extending the length thereof for slidably supporting a plurality of vane carriers, a plurality of vanes suspended from the carriers, a tilt rod extending through the carriers permitting sliding or traversing of the vanes between open and closed positions at one or both ends of the headrail, and a gearing system between the tilt rod and each carrier, whereby rotation of the rod causes a corresponding, simultaneous rotation or tilting of the vanes. The carriers and vanes are usually moved between the open and closed positions using a loop of cord at one end of the blind. The cord is connected to the carrier at the other end of the blind, so that pulling on one side of the cord loop moves the vanes in one direction, and pulling on the other side of the loop moves the vanes in the opposite direction. During opening or closing, the carriers slide along the stationary tilt rod. In order to rotate or tilt the vanes, the tilt rod is rotating using a chain and a gear system on one end of the rod. Thus, two separate controls are required to effect traversing and tilting of the vanes. The loops in the external ends of the cord and chain present a danger to small children. One solution to the problem proposed by the present inventor is to place the looped ends of the cord and chain in a housing mounted on a wall beneath the control end of the headrail.

Attempts have been made to provide a single control wand for actuating both the blind traversing and tilt mechanisms. One such attempt is described in U.S. Pat. No. 5,465,779, which issued to David Rozen on Nov. 14, 1995. The Rozen device includes a somewhat complicated wand structure, which would be expensive to mass produce and relatively difficult to operate.

SUMMARY OF THE INVENTION

An object of the present invention is to provide a vertical blind control for effecting both van traversing and vane tilting operations which is relatively simple in terms of both structure and operation.

Another object of the inventions is to provide a vertical blind control in which the bulk of the control elements are contained in a box at one end of the headrail, whereby, once the blind control is assembled, the elements are not readily accessible to user.

Accordingly, an aspect of the present invention provides a control for a vertical blind having a headrail, a plurality of carriers slidable in the headrail for movement between open and closed positions, a respective vane suspended from each of the carriers, a cord in the headrail connected to at least one of the carriers for causing the carriers to traverse between open and closed positions of the blind and a tilt rod extending through the carriers for rotating the carriers to tilt the vanes. The control comprises a control casing disposed on one end of the headrail. A shaft member is slidably and rotatably mounted in the casing. First and second gear elements are operatively mounted on the shaft member in opposed spaced apart relation. A drum member is rotatably mounted within the control casing, the drum carrying and frictionally engaging a portion of the cord to control traversing of the carriers by rotation of the drum. A third gear member is operatively coupled to the drum member and engageable with the first gear member. Finally, a fourth gear member is operatively disposed within the casing, the fourth gear member being rotationally coupled to the tilt rod and operatively engageable with the second gear member. When the shaft member is positioned in the control casing so that the first gear member engages the third gear member, rotation of the shaft member causes rotation of the third gear member and the drum to traverse the vanes. Similarly, when the shaft member is positioned in the control casing so that the second gear member engages the fourth gear member, rotation of the shaft causes rotation of the fourth gear member and the tilt rod to tilt the vanes.

A further aspect of the present invention provides a control for a vertical blind having a headrail, a plurality of carriers slidable in the headrail for movement between open and closed positions, a respective vane suspended from each of the carriers, a cord in the headrail connected to at least one of the carriers for causing the carriers to traverse between open and closed positions of the blind and a tilt rod extending through the carriers for rotating the carriers to tilt the vanes. The control comprises a control casing disposed on one end of the headrail. A shaft member is slidably and rotatably mounted in the casing. First and second gear elements are rotatably and slidably mounted on the shaft member. A latch means if provided for releasably coupling the shaft member to one of the first and second gear members. The shaft member is slidable between a first position in which the latch means rotationally couples the shaft member to the first gear member, and a second position in which the latch means rotationally couples the shaft member to the second gear member. A drum member is rotatably mounted within the control casing, the drum member carrying and frictionally engaging a portion of the cord to control traversing of the carriers by rotation of the drum. A third gear member is operatively coupled to the drum member and engaged with the first gear member. A fourth gear member is operatively disposed within the casing, the fourth gear member being rotationally coupled to the tilt rod and operatively engaged with the second gear member. When the shaft member is slid to its first position, rotation of the shaft member causes rotation of the first gear member which in turn causes rotation of the third gear member and the drum to traverse the vanes. Similarly, when the shaft member is slid to its second position, rotation of the shaft member causes rotation of the second gear member which in turn causes rotation of the fourth gear member and the tilt rod to tilt the vanes.

BRIEF DESCRIPTION OF THE DRAWINGS

Further features and advantages of the present invention will become apparent from the following detailed description, taken in combination with the appended drawings, in which:

FIGS. 12*a*–12*i* shows a collection of end views of various elements of the control of FIGS. 1 to 3.

DETAILED DESCRIPTION

The following description relates to a single blind. However, the same system with modifications obvious to a person skilled in the art can be used for a double blind, i.e. a vertical blind with two sets of vanes for opening to each side of a window opening.

Figure 1:
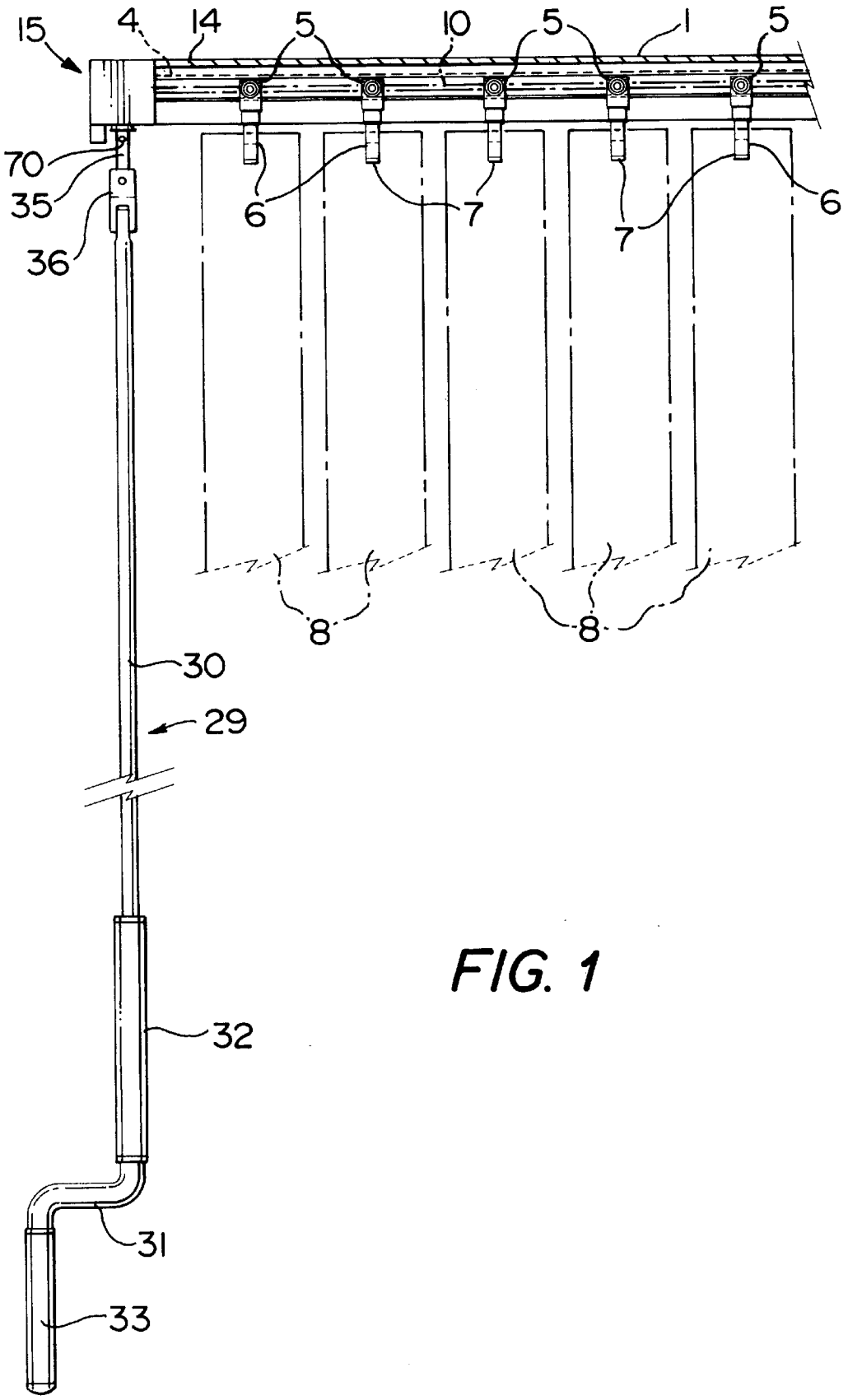
FIG. 1 is a schematic front view of one end of a vertical blind incorporating the control of the present invention.
Figure 2:
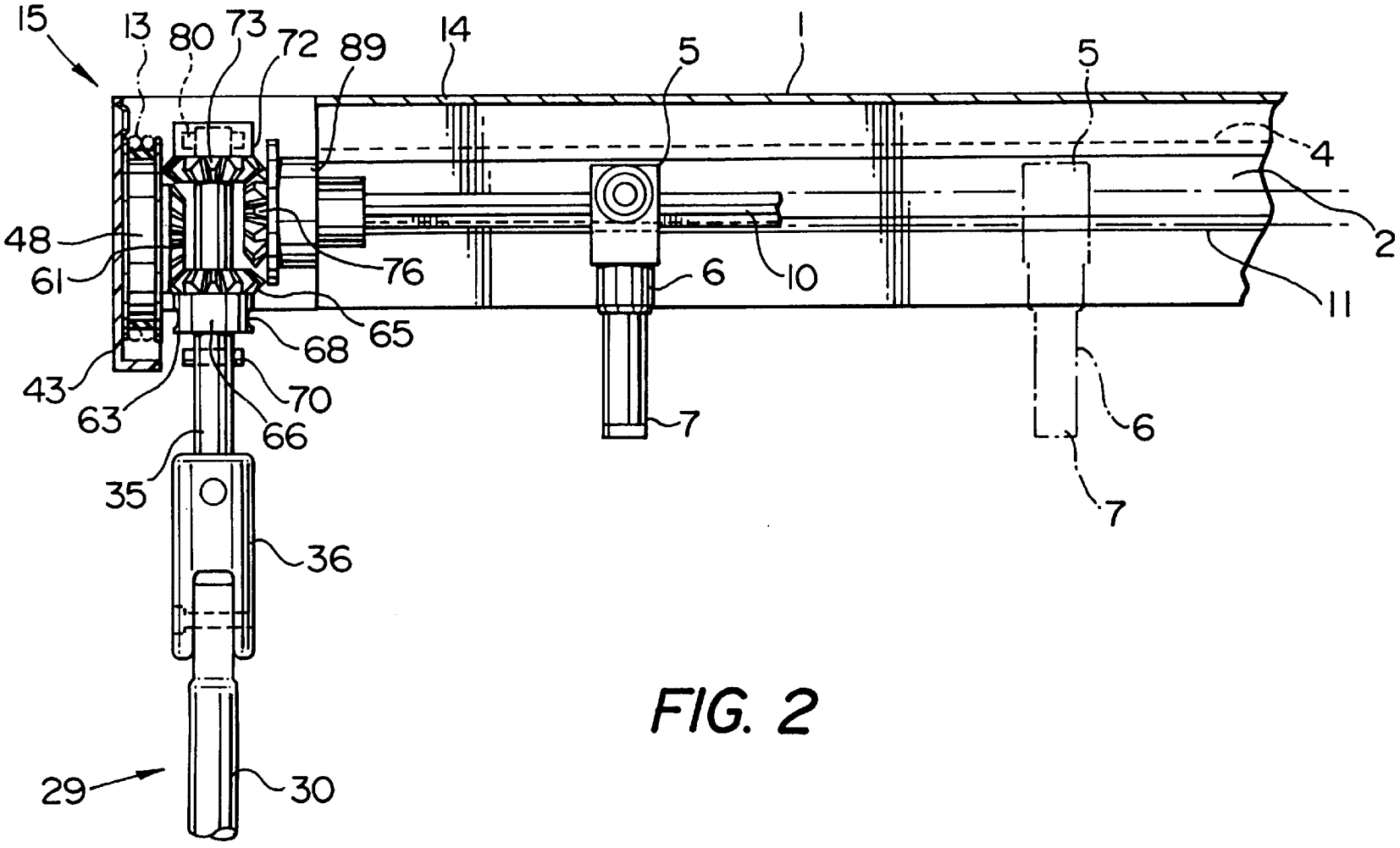
FIG. 2 is a schematic front view of the principal elements of the control of the present invention.
Figure 3:
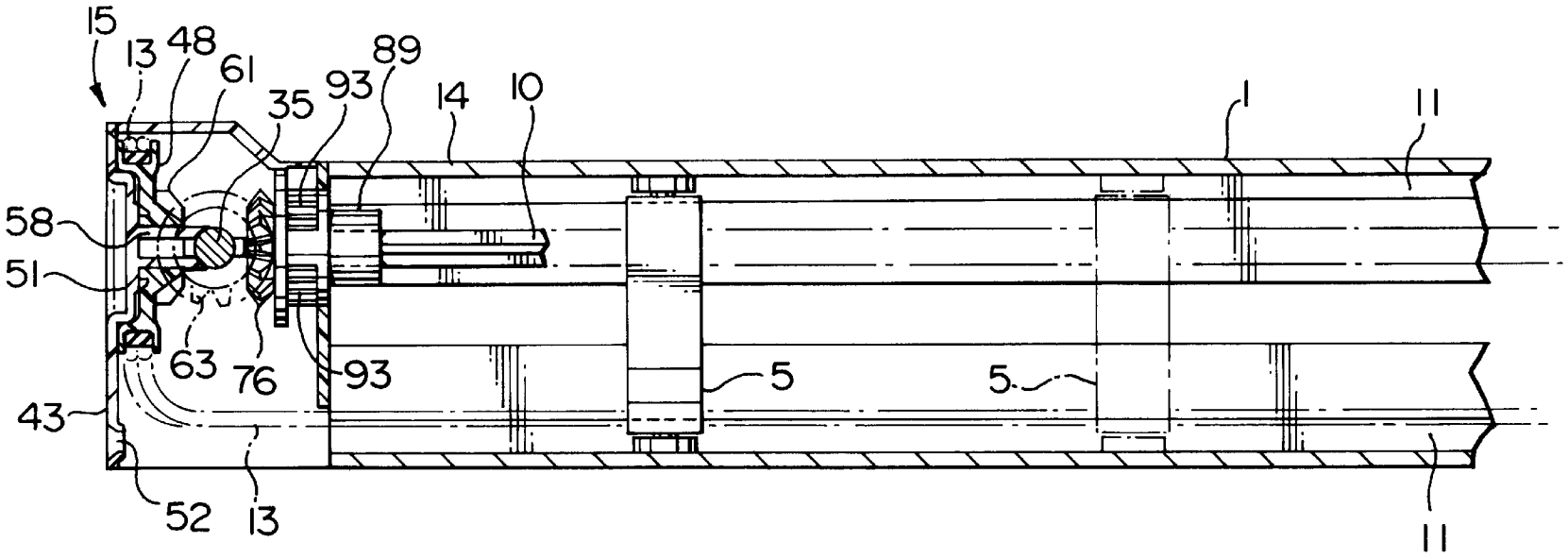
FIG. 3 is a schematic top view of the elements of control of FIG. 2.

With reference to FIGS. 1 to 3, the control of the present invention is designed for use on a vertical blind of the type including an elongated, generally rectangular casing commonly referred to as a headrail 1. The headrail 1 includes a pair of tracks 4 defined by the inner lower edge 2 of longitudinally extending rectangular grooves 9 (FIGS. 4 and 5) in the side walls 3 of the headrail 1 and rib 11 for slidably supporting a plurality of carriers 5. The carriers 5 are generally T-shaped. The vertical arms 6 of the carriers 5 include clips 7 at their bottom ends for receiving a plurality of more or less flat, planar vanes 8. By sliding the carriers 5 along the tracks 4, the vanes 8 are traversed, i.e. the blind is opened or closed. The vanes 8 are caused to move in unison using conventional plastic stringers (not shown) interconnecting the top ends of the carriers 5.

The vanes 8 can also be tilted, i.e. rotated around their longitudinal axes between positions in which they all lie in one plane with their side edges overlapping, and positions in which the vanes 8 are inclined with respect to or perpendicular to the longitudinal axis of the headrail 1. In the titled positions of the vanes 8 during the daytime, the blind admits more light than in the closed position of the vanes. The vanes 8 are tilted using a so-called tilt rod 10 extending the length of the headrail 1 through one side of each of horizontal top arms of the carriers 5. The rod 10, which is of cruciform cross section, engages a gear (not shown) in the horizontal arm of each carrier 5 for rotating the arms 6 and consequently the vanes 8 in unison. Of course, the carriers 5 are slidable along the tilt rod 10 for opening and closing the blind as a whole (rather than merely the vanes).

Figure 8:
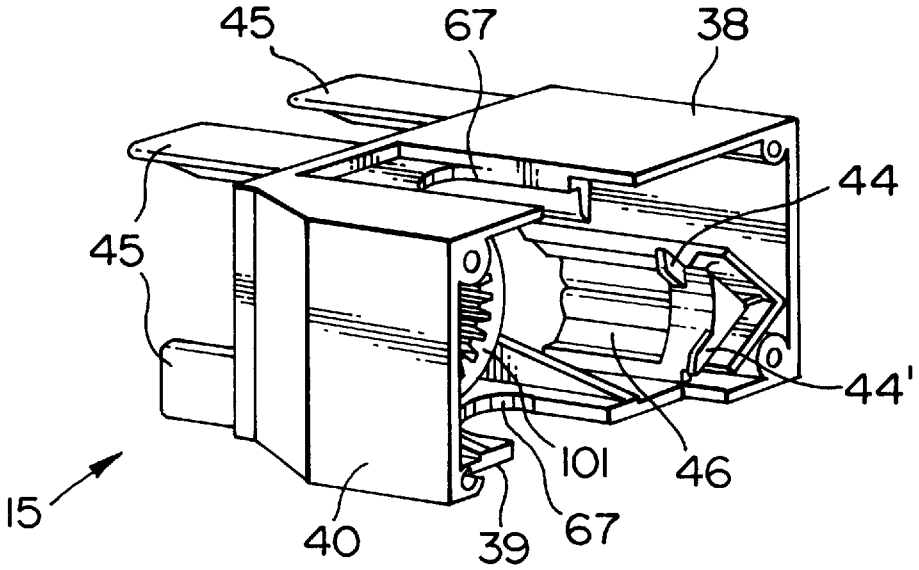
FIG. 8 is an isometric view from the other side and above of the casing of FIG. 7.

The vanes 9 are moved along the tracks in the headrail 1 between open (not shown) and closed positions (FIG. 1) using a cord 13 (FIGS. 2, 3 and 8). The cord 13 is connected to the carrier 5 furthest from the control end 14 of the headrail 1. The cord 13 extends from the end carrier 5 through each of the remaining carriers 5 into a control casing generally indicated at 15 at the control end 14 of the headrail, returns through the carriers 5 to an end cap 16 on the other end 17 of the headrail 1 and then returns to the end carrier 5.

Figure 5:
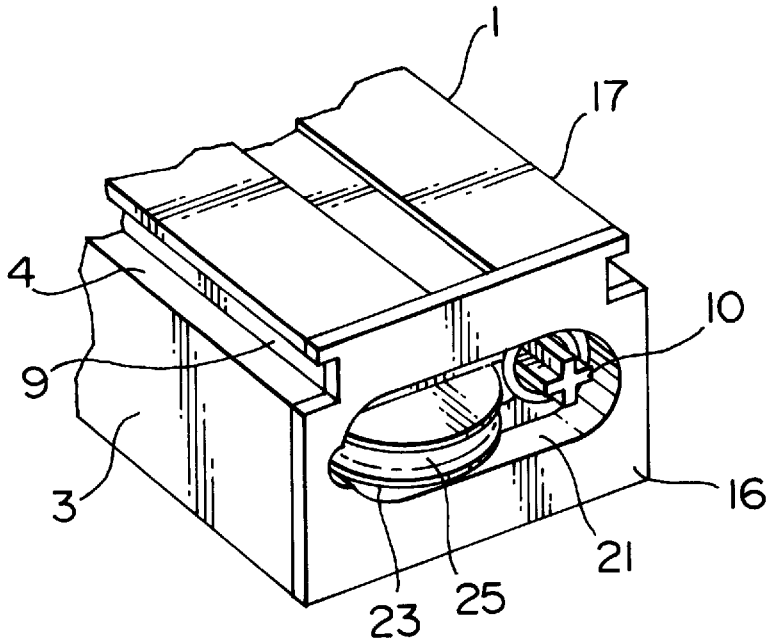
FIG. 5 is an isometric view of the other end of the headrail of FIG. 4.
Figure 6:
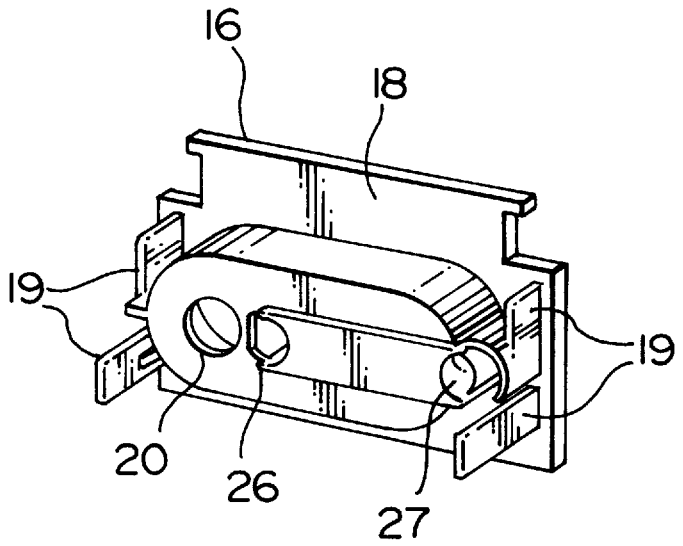
FIG. 6 is an isometric view of a cap on the end of the headrail of FIG. 5.

The end cap 16 (FIGS. 5 and 6) is generally a rectangular plate 18 conforming in shape to the end of the headrail 1, with lugs 19 extending outwardly from one side thereof for insertion into the headrail 1 for properly aligning the cord with the headrail. A hole 20 in a recess 21 in the outside of the plate 18 rotatably receives one free end of the tilt rod 10. A semicircular guide 23 with a concave groove 25 therein (resembling one-half of a fixed pulley) extends outwardly from the plate 18 for slidably receiving the cord 13. The cord 13 extends outwardly through one opening 26 on one side of the guide 23 and returns to the interior of the headrail 1 via a second opening 27 in the plate 18 on the other side of the guide 23.

The control of the present invention includes the casing 15 on the end 14 of the headrail 1. The control casing 15 contains a gear system (described hereinafter in greater detail) for traversing or tilting the vanes 8 using a single wand generally indicated at 29.

The wand 29 is defined by a plastic rod 30 with an inverted L-shaped handle 31 at the bottom end thereof. Sleeves 32 and 33 are mounted on the bottom end of the rod 30 and on the bottom end of the handle 31, respectively. The sleeves 32 and 33 are freely rotatable on the wand, facilitating manual rotation of the latter. The top end of the wand 29 is connected to the bottom end of a shaft 35 by a U-joint 36. The shaft 35, which forms part of the control of the present invention, is rotatably mounted in the casing 15.

Figure 4:
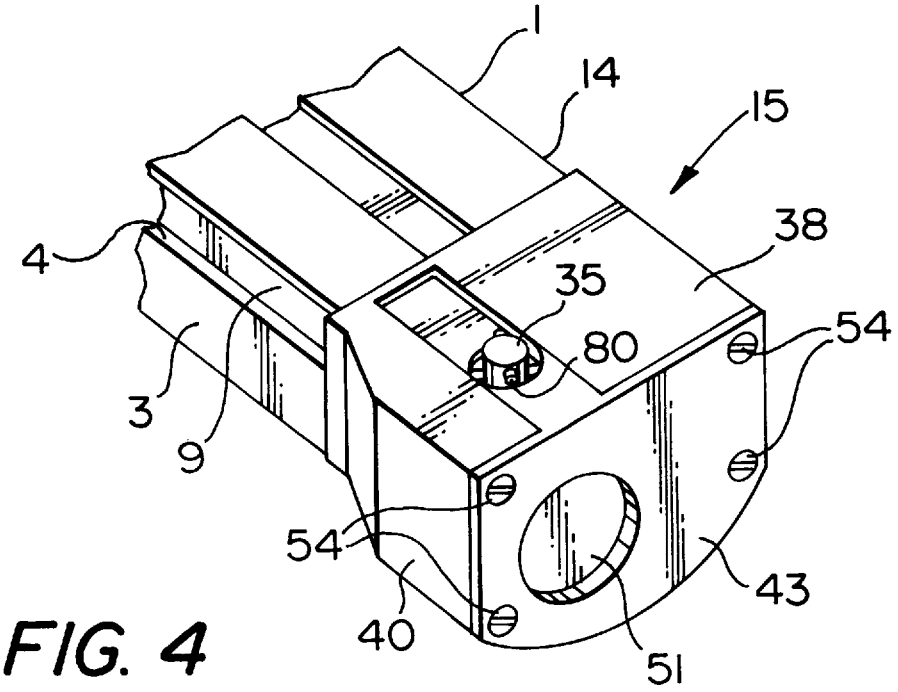
FIG. 4 is an isometric view of one end of a vertical blind headrail and casing for the control of the present invention.
Figure 7:
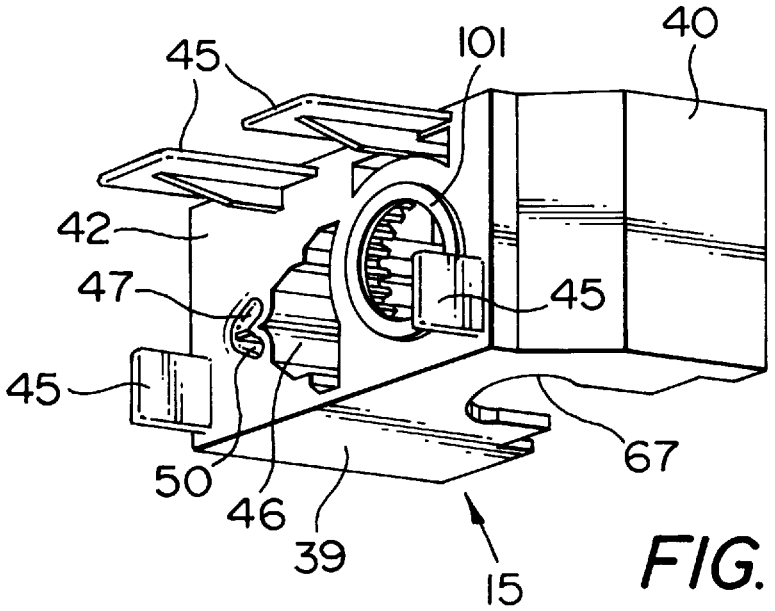
FIG. 7 is an isometric view from one side and below of the casing used in the control of FIGS. 1 to 3.
Figure 11:
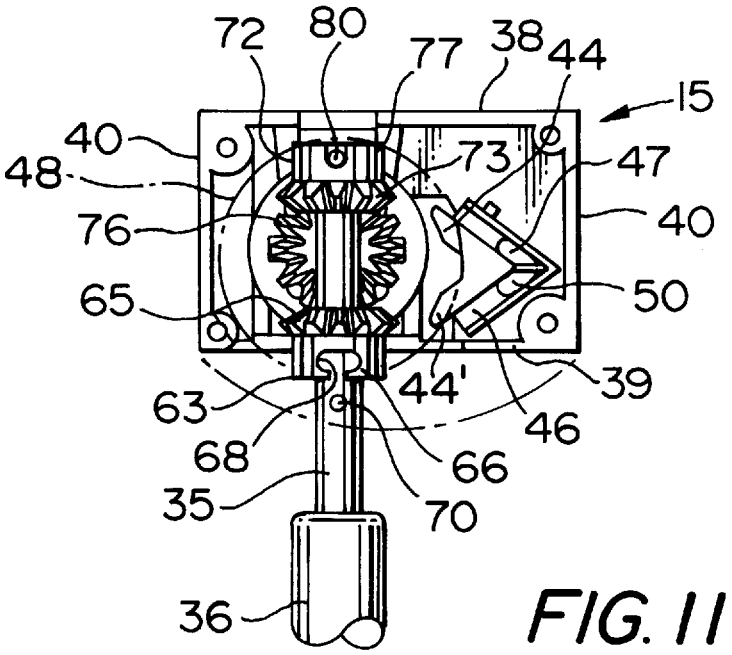
FIG. 11 is an end view of the casing and various elements of the control of FIGS. 1 to 3.
Figure 9:
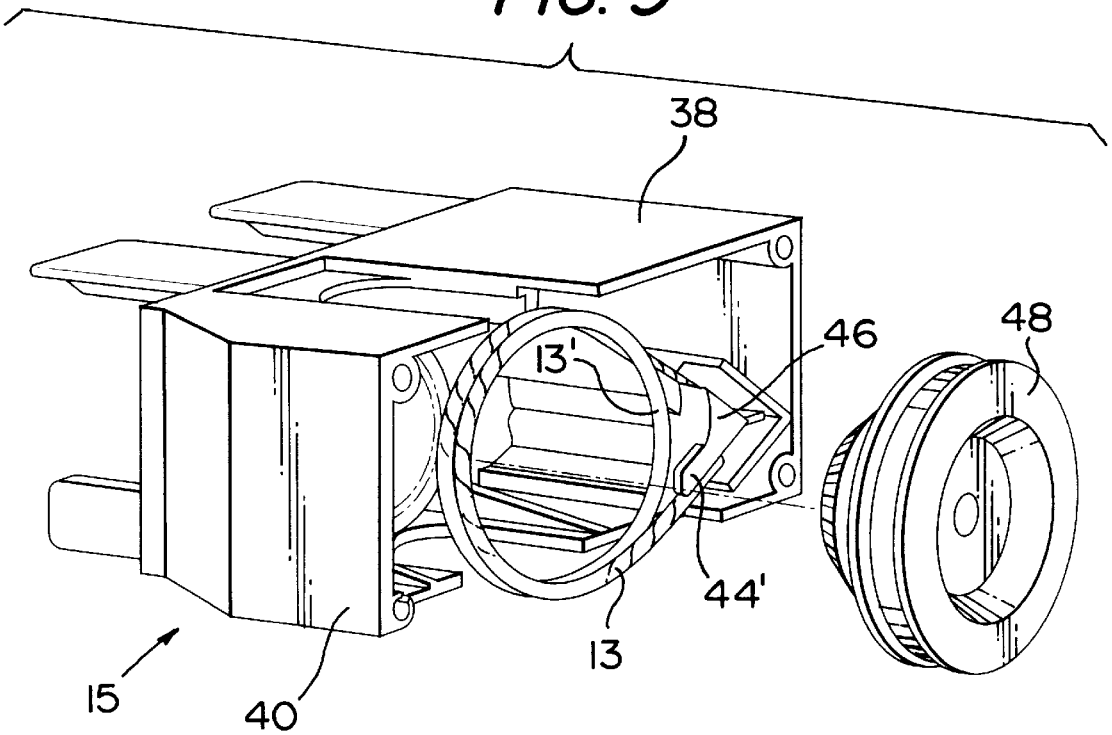
FIG. 9 is an isometric view of the casing used in the control of FIGS. 1 to 3, illustrating the path followed by a blind control cord within the casing.
Figure 10:
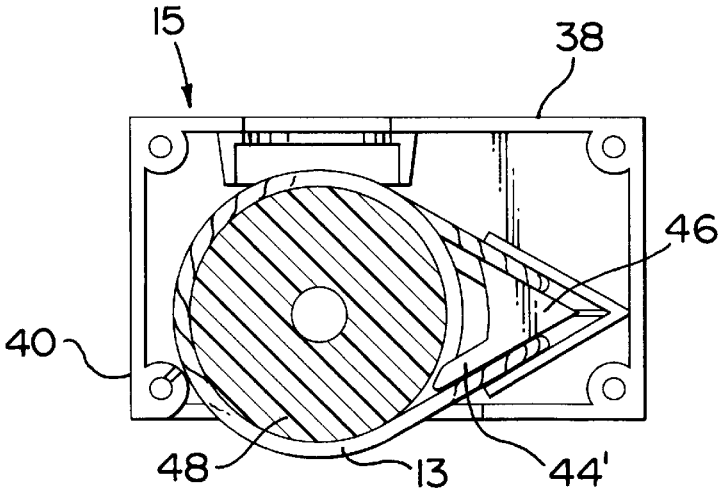
FIG. 10 is an end view of the casing of FIG. 9, further illustrating the path followed by a blind control cord within the casing.
Figures 13A, 13B, 13C, 13D, 13E, 13F, 13G, 13H, 13I:
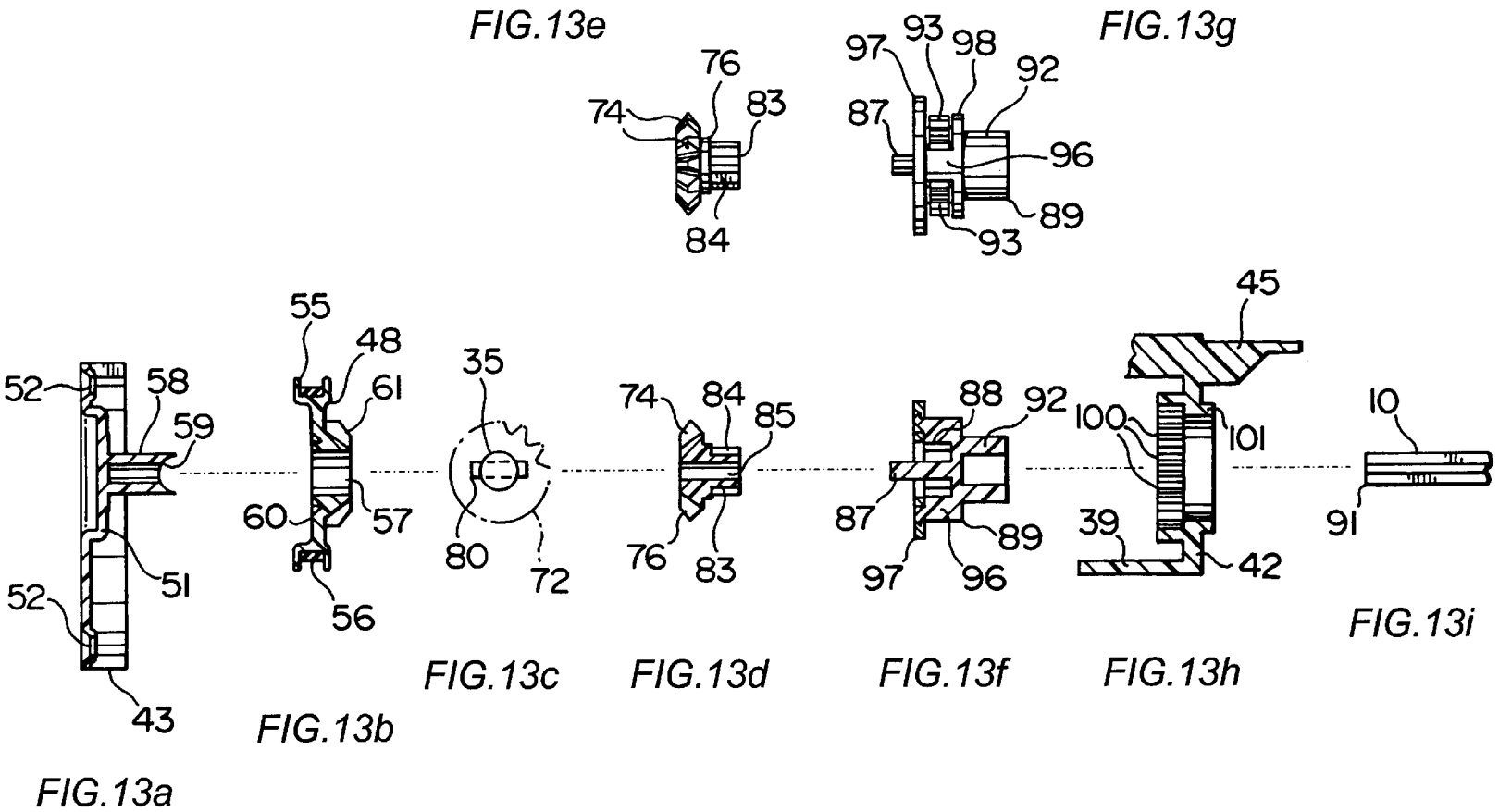
FIGS. 13*a*–13*i* shows a collection of top and side views (some in section) of various elements of the control of FIGS. 1 to 3.

As best shown in FIGS. 4, 7 and 8, the casing 15 is defined by a top wall 38, a bottom wall 39, side walls 40, an inner end wall 42 and a cover 43 (FIG. 4). The inner end wall 42 carries lugs 45, which extend into the headrail 1 ensuring proper alignment of the casing 15 and the headrail 1. A cord guide 46, with a generally v-shaped cross section extends into the casing 15. The cord 13 extends into the casing 15 from the headrail 1, through an opening 47 (FIGS. 7 and 9) in the guide 46 around a generally disc-shaped drum 48 (FIGS. 2, 10 and 11) rotatably mounted on the cover 43 and returns through a second opening 50 in the guide 46 to the interior of the headrail 1.

Referring to FIGS. 12*a*–12*i*, 13*a*–13*i*, the cover 43 includes a cylindrical projection 51 for rotatably supporting the drum 48. Holes 52 in the corners of the cover 43 receive screws 54 (FIG. 4) for securing the cover to the remainder of the casing 15. The cord 13 is wound in a rectangular cross section, annular groove 55 in the drum 48. A rubber ring 56 in the groove 55 prevents sliding of the cord 13 on the drum 48. Turning to FIGS. 5, 8, 9 and 10, to further prevent cord sliding on the drum 48 showing in phantom lines, a double loop of the cord 13 around the drum 48 is provided, the cord guide 46 including upper and lower guiding lugs 44 and 44' to maintain the crossing portion 13' of the cord 13 substantially centered within the groove 55 of the drum 48 (see FIGS. 9 and 10) to prevent cord interlacing. A central opening 57 is provided in the drum 48 for mounting the latter on a stub axle 58 extending into the casing from the center of the projection 51. The outer free end 59 of the stub axle is concave for stabilizing the shaft 35 in the casing 15 (see FIG. 3). A circular recess 60 in the outer side of the drum 48 rides on the projection 51. A bevel gear 61 integral with drum 48 extends inwardly into permanent engagement with a lower bevel gear 63 mounted on the shaft 35.

The bevel gear 63 includes tapered teeth 65 on the upper end thereof for engaging the gear 61, and a sleeve 66 extending downwardly through an opening 67 (FIGS. 8 and 12*h*) in the bottom wall 39 of the casing 15. A pair of diametrically opposed, generally circular notches 68 are provided in the bottom end of the sleeve 66 for receiving a pin 70 extending through the shaft 35. As described hereinafter in greater detail, when the pin 70 is in the notches 68, the rotation of the shaft 35 results in corresponding rotation of the gears 63 and 61 and the drum 48. Depending upon the direction of rotation, the cord 13 is wound in either direction to open or close the blind, i.e. to move the vanes 8 along the headrail 1 from the open to the close position or vice versa.

A second or upper bevel gear 72, (FIGS. 11 and 12*a*) which is similar to the gear 63, is mounted on the top end of the shaft 35 in opposition to the gear 63. The gear 72 includes tapered teeth 73 which permanently engage the teeth 74 of a fourth bevel gear 76 (FIGS. 11, 12*a*–12*c* and 13*c*–13*e*). However, the gear 72 is above the gear 61 on the drum 48 so that the upper gear 72 never engages the gear 61. The hollow upper bevel gear 72 includes an upwardly extending sleeve 77 (FIGS. 11 and 12*a*) permitting rotation of the shaft 35 relative to the gear, i.e. the shaft 35 is freely rotatable in the gear 72. Four generally circular notches 78 at 90° to each other are provided in the top edge of the sleeve 77 for receiving a second pin 80, extending through the shaft 35 near the top end thereof. When the pin 80 is in a pair of opposed notches 78, i.e. when the shaft 35 is in the normal lower rest position, rotation of the shaft 35 results in corresponding rotation of the upper gear 72 and the fourth bevel gear 76.

The gear 76 is used to rotate the tilt rod 10 and consequently to tilt the vanes 8. Rotation of the gear 76 is transmitted to the rod 10 by a planetary gear system, the elements of which are best shown in FIGS. 11, 12*a*–12*c* and 13*c*–13*e*. As well as the teeth 74, the fourth bevel gear 76 includes a sleeve 83 with longitudinally extending teeth 84 on the outside thereof. A longitudinally extending passage 85 through the gear 76 is used to rotatably mount the gear on a pin 87 extending outwardly from a cylindrical recess 88 in one end of a planetary gear support and tilt rod carrier 89. The gear support 89 is rotatably mounted in the inner end wall 42 of the casing 15 (See FIG. 7). One end 91 of the tilt rod 10 is mounted in the body 92 of the gear support 89 extending into the headrail 1. The gear support 89 carries four spur gears 93 which are spaced equidistant apart in the body 92 of the support. The body 92 includes spacer lugs 96 between the recesses containing the gears 93, the lugs 96 snapping into an annular end plate 97 spaced apart from a flange 98 on the body 92 for ease of assembly. Thus, the gears 93 are rotatably mounted between the end plate 97 and the flange 98, i.e. the axles (not shown) of the gears 93 extend from the holes 99 in the end plate 97 into the flange 98.

The spur gears 93 engage the teeth 100 of an annular box gear 101 which forms part of the inner end wall 42 of the casing 15. Rotation of the upper bevel gear 72, when the latter is latched to the shaft 35 by the pin 80, results in corresponding rotation of the hollow fourth bevel gear 76. The teeth 84 on the sleeve 83, which is part of the gear 76 rotate the spur gears 93. The gears 93, in effect travel around the fixed box gear 101 causing the gear support 89 to rotate in the box gear 101. Because one end of the tilt rod 10 is fixedly mounted in the support 89, the rod 10 is caused to rotate. Such rotation of the tilt rod 10 causes a corresponding rotation or tilting of the vanes 8 around their longitudinal axes(axis).

In operation, with the wand 29 and the shaft 35 in the lower, rest position (FIG. 2), the upper pin 80 in the shaft 35 engages the upper bevel gear 72. Rotation of the wand 29 and the shaft 35 results in corresponding rotation of the upper bevel gear 72, the hollow gear 76, the spur gears 93, the gear support 89, and the tilt rod 10 causing the vanes 8 to tilt. If upward pressure is exerted on the wand 29, the shaft 35 slides upwardly in the gears 63 and 72 until the bottom pin 70 in the shaft 35 engages the lower bevel gear 63, while the top pin 80 moves out of the upper bevel gear 72. Rotation of the shaft 35 causes corresponding rotation of the bevel gears 63 and 61, and the drum 48. When the drum 48 rotates, the cord 13 is wound in one direction or the other (depending upon the direction of rotation of the wand 29) on the drum 48 to move the vanes 8 longitudinally of the headrail 1, i.e. to open or close the blind.

In a simpler form of the apparatus (not shown), the lower bevel gear 63 and the upper bevel gear 72 are fixed on the shaft 35. In this case the upper and lower bevel gears 63, 72 are mounted on the shaft 35 and separated by sufficient distance so that in the lower, rest position of the shaft 35 the upper gear 72 engages the fourth gear 76 while the lower gear 63 is clear of, and thus does not engage the gear 61 on the drum 48.

In operation, in the lower, rest position of the wand 29, with the upper gear 72 engaging the fourth gear 76, rotation of the wand 29 and the shaft 35 results in corresponding rotation of the gear 76 and the tilt rod 10 to tilt the vanes 8. When the wand 29 and consequently the shaft 35 are pushed upwardly, the upper gear 72 moves out of engagement with the fourth gear 76, and the lower gear 63 moves into engagement with the bevel gear 61 on the drum 48. Rotation of the wand 29 in the elevated position results in corresponding rotation of the gears 63 and 61 and consequently the drum 48 to open or close the blind, i.e. to move the carriers 5 and the vanes 8 laterally.

We claim:

1. A vertical blind comprising a headrail, a plurality of carriers slidable in the headrail for movement between open and closed positions, a respective vane suspended from each of the carriers, a cord in the headrail connected to at least one of the carriers for causing the carriers to traverse between open and closed positions of the blind, a tilt rod extending through the carriers for rotating the carriers to tilt the vanes, and a control mechanism capable of selectively controlling traversing and rotation of the carriers, said control mechanism comprising:

a control casing disposed at one end of the headrail;

a shaft member slidably and rotatably mounted in the casing; the shaft member being slidable in a longitudinal direction of the shaft member between first and second positions;

first and second gear elements operatively mounted on the shaft member in opposed spaced apart relation; the first and second gear elements being selectively engageable with the shaft member;

a drum member rotatably mounted within the control casing, the drum member carrying and frictionally engaging a portion of the cord to control traversing of the carriers by rotation of the drum member;

a third gear member operatively coupled to the drum member and engageable with the first gear member; and a fourth gear member operatively disposed within the casing, the fourth gear member being rotationally coupled to the tilt rod and operatively engageable with the second gear member;

wherein when the shaft member is positioned in the control casing so that the shaft member engages the first gear member, rotation of the shaft member causes rotation of the third gear member and the drum member to traverse the vanes, and when the shaft member is positioned in the control casing so that the shaft member engages the second gear member, rotation of the shaft causes rotation of the fourth gear member and the tilt rod to tilt the vanes.

2. A vertical blind as defined in claim 1, further comprising an elongate wand member operatively connected to an end of the shaft member, the elongate wand being capable of controlling both rotation and sliding motion of the shaft member within the control casing.

3. A vertical blind as defined in claim 1, wherein the drum member is integral with the third gear member.

4. A vertical blind as defined in claim 1, wherein the fourth gear member is rotationally coupled to the tilt rod through a planetary gear assembly.

5. A vertical blind comprising a headrail, a plurality of carriers slidable in the headrail for movement between open and closed positions, a respective vane suspended from each of the carriers, a cord in the headrail connected to at least one of the carriers for causing the carriers to traverse between open and closed positions of the blind, a tilt rod extending through the carriers for rotating the carriers to tilt the vanes, and a control mechanism capable of selectively controlling traversing and rotation of the carriers, said control mechanism comprising:

a control casing disposed at one end of the headrail;

a shaft member slidably and rotatably mounted in the casing;

first and second gear elements rotatably and slidably mounted on the shaft member;

latch means capable of releasably coupling the shaft member to one of the first and second gear members, the shaft member being slidable between a first position in which the latch means rotationally couples the shaft member to the first gear member, and a second position in which the latch means rotationally couples the shaft member to the second gear member;

a drum member rotatably mounted within the control casing, the drum member carrying and frictionally engaging a portion of the cord to control traversing of the carriers by rotation of the drum member;

a third gear member operatively coupled to the drum member and engaged with the first gear member; and a fourth gear member disposed within the casing, the fourth gear member being rotationally coupled to the tilt rod and operatively engaged with the second gear member;

wherein when the shaft member is slid to its first position, rotation of the shaft member causes rotation of the first gear member which in turn causes rotation of the third gear member and the drum member to traverse the vanes, and when the shaft member is slid to its second position, rotation of the shaft member causes rotation of the second gear member which in turn causes rotation of the fourth gear member and the tilt rod to tilt the vanes.

6. A vertical blind as defined in claim 5, further comprising an elongate wand operatively connected to an end of the shaft member for selectively rotating and sliding the shaft member in the control casing.

7. A vertical blind as defined in claim 6, wherein the wand is connected to the shaft member through a universal joint.

8. A vertical blind as defined in claim 5, wherein the drum member is integral with the third gear member.

9. A vertical blind as defined in claim 5, wherein the fourth gear member is rotationally coupled to the tilt rod through a planetary gear assembly.

10. A vertical blind as defined in claim 9, wherein the planetary gear assembly comprises: a ring gear fixedly disposed in the control casing; a gear support member fixedly mounted on an end of the tilt rod and rotatable in the control casing, the fourth gear member being rotatably mounted on the gear support member substantially concentrically with the tilt rod; a spur gear portion fixedly disposed on the fourth gear member and acting as a sun gear; and at least one planet gear rotationally mounted on the gear support member and operatively engaged with the ring gear and the spur gear portion of the fourth gear member, whereby rotation of the fourth gear member results in corresponding rotation of said at least one planet gear, thereby causing rotation of the gear support member and the tilt rod to tilt the vanes.

11. A vertical blind as defined in claim 5, wherein each of the first and second gear members comprise a bevel gear portion.

12. A vertical blind as defined in claim 11, wherein each of the third and fourth gear members comprise a bevel gear portion.

13. A vertical blind as defined in claim 5, wherein the latch means comprises a protrusion extending from a surface of the shaft member; and a notch portion disposed on each of the first and second gear members for releasably receiving the protrusion.

14. A vertical blind as defined in claim 13, wherein the protrusion is defined by an end of a pin extending at least partially through the shaft member.

15. A vertical blind as defined in claim 14, wherein the pin extends completely through the shaft member, opposite ends of the pin forming corresponding protrusions on opposite sides of the shaft, and wherein the first and second gear members include a pair of opposed notch portions for releasably receiving the protrusions.

16. A vertical blind as defined in claim 13, comprising first and second protrusions disposed on the shaft member and longitudinally separated from each other, the first protrusion engaging the first gear member when the shaft member is in its first position, and the second protrusion engaging the second gear member when the shaft member is in its second position.

17. A vertical blind as defined in claim 16, wherein the protrusions are individually defined by an end of a pin extending at least partially through the shaft member.

18. A vertical blind as defined in claim 17, wherein the pin extends completely through the shaft member, opposite ends of the pin forming corresponding protrusions on opposite sides of the shaft, and wherein the first and second gear members include a pair of opposed notch portions for releasably receiving the protrusions.

* * * * *